United States Patent [19]

Berry

[11] Patent Number: 4,565,312

[45] Date of Patent: Jan. 21, 1986

[54] POWDER ACTUATED TOOL WITH SAFETY

[75] Inventor: Brian E. Berry, Indianapolis, Ind.

[73] Assignee: Uniset Corporation, Indianapolis, Ind.

[21] Appl. No.: 703,135

[22] Filed: Feb. 19, 1985

[51] Int. Cl.[4] ..... B25C 1/14

[52] U.S. Cl. ..... 227/8; 227/10

[58] Field of Search ..... 227/7, 8, 9, 10, 11

[56] References Cited

U.S. PATENT DOCUMENTS

| | | | |
|---|---|---|---|
| 3,558,032 | 1/1971 | Oelinger | 227/8 |
| 3,620,433 | 11/1971 | Lawton | 227/10 |
| 4,165,676 | 8/1979 | Siegmann | 227/8 X |
| 4,252,259 | 2/1981 | Brosius | 227/8 |
| 4,384,668 | 5/1983 | Tutomu et al. | 227/8 |

*Primary Examiner*—Paul A. Bell

*Attorney, Agent, or Firm*—William W. Jones

[57] ABSTRACT

The tool is used for explosively driving fasteners or the like into supporting surfaces, such as masonry. It is designed for the do-it-yourself user and includes a safety which requires that both hands be used to fire the tool. The tool is of the type which includes a barrel which is reciprocally slidably mounted on a housing and must be pressed breechwardly to cock the firing assembly for firing. A barrel blocking member is mounted on the housing and must be manually disabled from blocking the barrel before the latter may be caused to cock the firing mechanism. The blocking member is so located that it cannot be disabled by the same hand which grasps the tool's pistol grip and pulls the trigger when the tool is fired.

8 Claims, 2 Drawing Figures

POWDER ACTUATED TOOL WITH SAFETY

Figure 1:
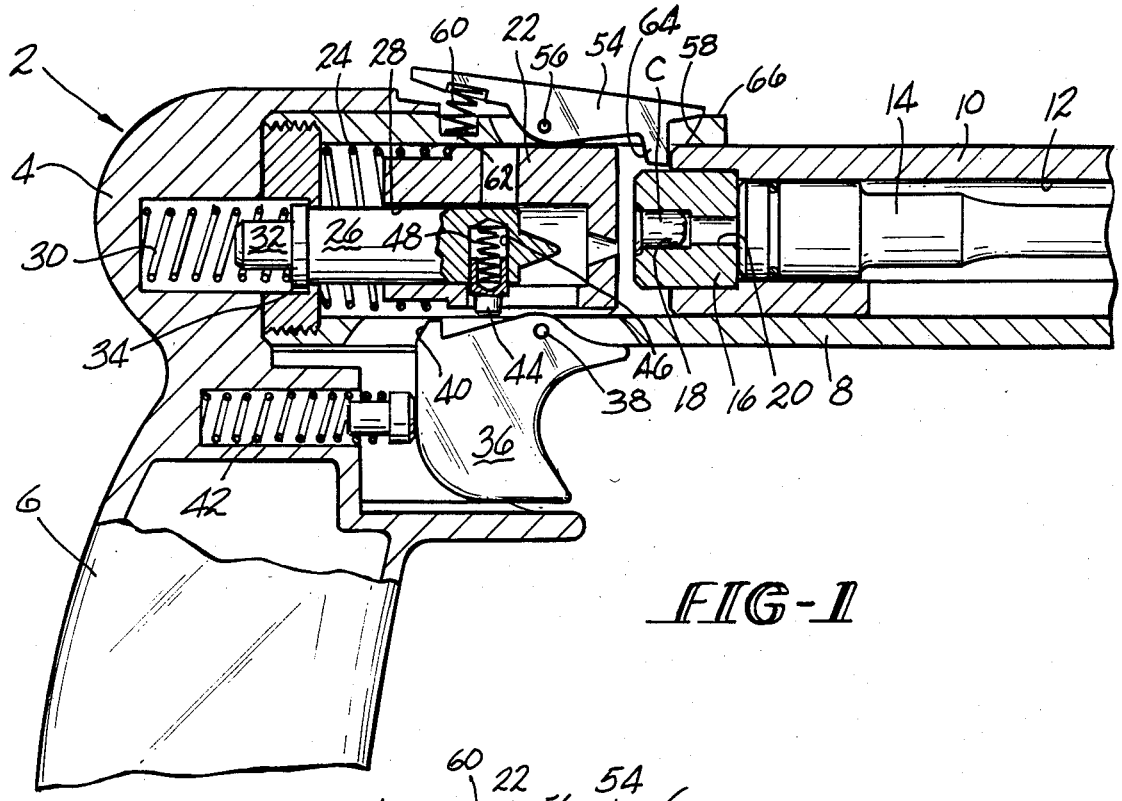

This invention relates to a powder actuated tool which fires blank ammunition to drive fasteners or the like into supporting surfaces, such as masonry, or the like. More particularly, this invention relates to such a tool which requires the operator to use both hands to cock and fire the tool.

Powder actuated tools which are used for driving fasteners or the like into concrete, wood, masonry, or the like supporting surfaces are well known in the prior art. Such tools will conventionally include a barrel which is movably mounted on a housing. The barrel may include a fastener driving ram in its bore which is moved from a breechward driving position to a muzzleward driven position by the expanding combustion gases of a fired blank cartridge. The housing will typically include a pistol grip type handle, a manually actuated trigger, and will house the firing mechanism for the tool. In order to minimize the possibility of air firing of the tool, the tool muzzle must usually be pressed against the surface into which the fastener is to be fired in order to cock the firing mechanism. If the tool is lifted away from the surface, the firing mechanism will uncock and will not fire. Such tools can be fired with one hand after push-down to cock the tool, and, thus are generally restricted to commercial construction uses by trained operators.

In addition to the trigger operated fastener driving tools described above, there also exist in the prior art hammer actuated powder tools which are actuated by being struck with a hammer. Such tools may include a ram but will not include a pistol grip and a trigger. These tools will break open for loading the firing chamber with a blank cartridge. The tool will include a firing pin which is spring biased in the breechward direction away from the cartridge, and which includes a striking face which projects from the breechward end of the tool housing. To fire the tool, one strikes the striking face of the firing pin with a hammer, thus driving the firing pin against the bias of its firing pin spring and into the cartridge. Tools of this type may sometimes be used in commercial construction, but the majority of their use is by the home do-it-yourselfer because the user cannot fire the tool with only one hand. The user must use two hands to fire the tool, one to grip the tool, and the other to grip the hammer, and, for this reason, the tool is deemed safe enough for use by the home do-it-yourselfer.

The tool of this invention is adapted for use by the home do-it-yourselfer in that it cannot be operated with only one hand, however, this tool has the more convenient and comfortable configuration of a standard industrial powder actuated tool which includes a pistol grip handle and a finger-actuated trigger. The tool of this invention does not require the use of a hammer or other supplemental tool in order to be operated.

The tool includes a housing which has a pistol grip, a cradle portion, and which generally forms the breech end of the tool. The firing mechanism is mounted in the tool housing. The tool also includes a barrel which is reciprocally movably mounted in the housing cradle. The barrel has a breech end which includes a cartridge firing chamber, and the barrel houses a fastener driving ram in its bore. The barrel is slidable in the housing in a muzzleward direction to a breech-open loading position wherein the firing chamber is exposed so that a blank cartridge can be loaded therein. Once loaded, the barrel can be slid breechward toward a breech-closed position from which push-down of the tool against a surface into which the fastener is to be driven will cause the barrel to undergo further breechward movement. During this latter increment of breechward movement, the barrel moves against the breechblock and pushes the latter and the firing pin breechward to a cocked position. Once in the cocked position, the trigger can be pulled to fire the tool. The tool is provided with a blocking member which is mounted on the housing and which normally is positioned in a blocking position so as to prevent the barrel from moving from its breech-closed position through its cocking stroke. The blocking member must be manually disabled with one hand by the operator while the operator's other hand grips the tool handle to push the tool against the surface into which the fastener is to be fired. With the blocking member disabled, the barrel is free to move through its cocking stroke against the breech block so as to cock the tool for firing. After the tool is fired, and the barrel is moved muzzleward to its breech-open extraction and loading position, the blocking member automatically returns to its barrel-blocking position wherein it will prevent subsequent cocking movement of the barrel unless the blocking member is again manually disabled.

It is, therefore, an object of this invention to provide a powder-actuated fastener-driving tool which must be operated with two hands thereby providing additional safety for do-it-yourself home use.

It is a further object of this invention to provide a tool of the character described which includes a pistol grip, a reciprocating barrel, and a trigger which is manually operated in a conventional manner.

It is yet another object of this invention to provide a tool of the character described which is cocked by pressing the barrel against a work piece into which a fastener is to be driven.

It is an additional object of this invention to provide a tool of the character described which includes a barrel-blocking member to prevent cocking of the tool unless the barrel-blocking member is manually disabled.

It is another object of this invention to provide a tool of the character described which requires the use of one hand of the operator to operate the trigger and the use of the other hand of the operator to disable the blocking member so that the tool can be cocked.

Figure 2:
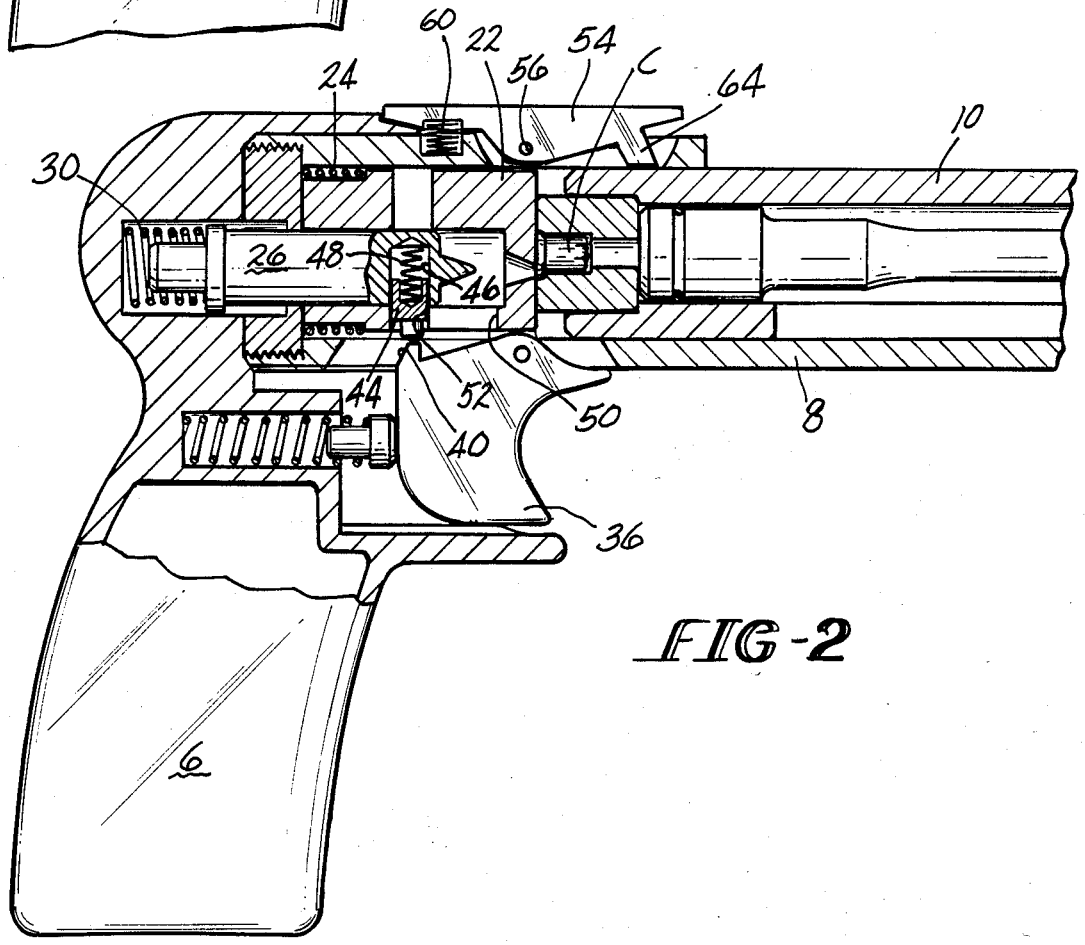

These and other objects and advantages of the tool of this invention will become more readily apparent to those skilled in the art from the following detailed description of a preferred embodiment thereof when taken in conjunction with the accompanying drawings, in which:

FIG. 1 is a fragmented sectional view of a preferred embodiment of a tool formed in accordance with this invention and showing the tool in a breech-closed, uncocked condition; and FIG. 2 is a view similar to FIG. 1 but showing the tool in a cocked, ready to fire condition.

Referring now to the drawings, there is shown in FIG. 1 a preferred embodiment of a tool formed in accordance with this invention. The tool includes a housing denoted generally by the numeral 2. The housing 2 includes a breech portion 4 which, in turn, includes a pistol grip part 6. The housing 2 also includes a cradle portion 8 which telescopes into the breech portion 4 and is secured thereto by bolts (not shown). A barrel 10 is mounted in the cradle portion 8 for reciprocal sliding movement in the breechward and muzzleward directions. The barrel 10 includes a bore 12 in which is slidably mounted a fastener-driving ram 14. A firing chamber insert 16 is removably mounted in the breechward end of the barrel 10. The insert 16 includes a firing chamber 18 and a through bore 20 which communicates with the barrel bore 12.

The firing mechanism is similar to the mechanism shown in U.S. patent application Ser. No. B 394,684, filed July 2, 1982 to R. J. Kopf. The firing mechanism includes a breech blocck 22 which is slidably reciprocally mounted in the cradle portion 8 and biased in the muzzleward direction by a spring 24. A firing pin 26 is reciprocally slidably mounted in a bore 28 in the breech block 22 and is biased in the muzzleward direction by a spring 30. The spring 30 is mounted on a spring guide 32 portion of the firing pin 26 and engages a split washer 34 releasably mounted on the spring guide 32. A trigger 36 is mounted on a transverse pin 38 and includes a tang 40. A spring 42 biases the trigger 36 about the pin 38 in the counter-clockwise direction. A firing pin pawl 44 is mounted in a blind bore 46 and is biased by a spring 48 into a slot 50 in the breech block 22. The slot 50 has a searing surface 52 which engages the firing pin pawl 44 after the tool has been fired and the barrel 10 has been moved muzzleward in the cradle 8 to expose the firing chamber 18 and allow the fired cartridge to be extracted therefrom. It will be understood that in order to extract a fired cartridge from the firing chamber 18, the barrel 10 will be moved to an extraction position which is further muzzleward than the position shown in FIG. 1, in which position the firing chamber 18 will be exposed so that the fired cartridge can be extracted and ejected from the tool and a fresh cartridge can be loaded into the firing chamber 18. When the barrel 10 is moved muzzleward for extraction and reloading, the breechblock 22 moves forward in the cradle 8 under the influence of the spring 24 to the position shown in FIG. 1. The firing pin 26 is, at the same time, held in place in the bore 28 by the washer 34. In this fashion, the pawl 44 is displaced rearwardly of the slot 50 until the pawl 44 is pushed down by the spring 48 into engagement with the searing surface 52.

After the tool is reloaded, to recock for firing the barrel 10 is pushed breechwardly in the cradle 8 toward the breech block 22. A blocking or stop member 54 is mounted on the cradle 8 for pivotal movement about a pin 56. The stop 54 is mounted in a slot 58 formed in the cradle 8 and is biased about the pin 56 in the clockwise direction by a spring 60, which is seated in a well 62 formed in the cradle 8. The stop 54 includes a finger 64, which projects downward through the slot 58 and into the bore of the cradle 8. The nose 66 of the stop 54 engages the cradle 8 to limit the extent of clockwise pivoting of the stop 54 and ensures that the spring 60 will not disengage from the stop 54. It will be noted that when the stop 54 is in its operable position shown in FIG. 1, the finger 64 lies in the path of the movement of the barrel 10 so that the latter cannot be pushed sufficiently breechward to contact the breech block 22. Thus, as shown in FIG. 1, the tool is in a safe condition wherein it cannot be cocked since the barrel 10 cannot touch the breech block 22. Likewise, the tool cannot be dropfired because the firing pin cannot touch the chambered cartridge.

In order to cock the tool and fire it, the operator must use one hand to grasp the grip 6 to enable finger actuation of the trigger 36. With the other hand, the operator depresses the stop 54 so as to pivot it about the pin 56 in a counter-clockwise direction and compress the spring 60. This will move the stop 54 to a clear position shown in FIG. 2 in which the finger 64 is lifted out of the breechward path of travel of the barrel 10. The tool can then be pushed down to move the barrel 10 against the breech block 22 to cause the latter and the firing pin 26 to move in the breechward direction in the cradle 8. The springs 24 and 30 are thus compressed as the firing pin pawl 44 is moved into alignment with the trigger tang 40. In the position shown in FIG. 2, the tool is fully cocked and will fire when the trigger 36 is pulled. Pulling the trigger 36 causes the tang 40 to move against the firing pin pawl 44 causing the latter to move into the blind bore 46 and out of engagement with the searing surface 52. When the pawl 44 clears the searing surface 52, the spring 30 drives the firing pin 26 forward, whereupon the firing pin 26 strikes the cartridge C. When the barrel 10 is then pulled forward to extract and reload the tool, the stop 54, if not manually disabled, will automatically pivot back to the safe position shown in FIG. 1, and, to fire the tool again, the stop will again have to be manually disabled.

It will be readily appreciated that the tool of this invention provides for increased safety due to the fact that it requires the use of both of the operator's hands to fire. It also provides increased safety in that by holding the firing chamber away from the breech block face and the firing pin, unless the tool is grasped in a certain way to release the barrel for cocking, the incidence of accidental drop fire is greatly decreased. The tool is generally similar to the type of powder actuated tool used by tradesmen but is adapted for use by the do-it-yourselfer.

Since many changes and variations of the disclosed embodiment of the invention may be made without departing from the inventive concept, it is not intended to limit the invention otherwise than as required by the appended claims.

What is claimed is:

1. A powder actuated tool comprising:

(a) a housing comprising a pistol grip and a cradle portion;

(b) a firing mechanism mounted on said housing, said firing mechanism including a trigger disposed adjacent to said pistol grip, and a breech block reciprocally siidably mounted in said housing, said breech block being movable between a breechward cocked position and a muzzleward uncocked position.;

(c) a barrel reciprocally slidably mounted on said housing cradle, said barrel being movable between a breech open position and a breech closed position and return, and said barrel being movable through a cocking stroke to move said breech block to said cocked position to cock the tool for firing; and (d) stop means mounted on said housing and movable between a blocking position lying in the path of movement of said barrel through said cocking stroke, and a clear position offset from the path of movement of said barrel through said cocking stroke, said stop means being offset from said trigger sufficiently to prevent concurrent one-handed actuation of said trigger and said stop means.

2. The tool of claim 1 wherein said stop means is spring biased toward said blocking position.

3. The tool of claim 1 wherein said stop means includes a finger which engages a breechward end of said barrel when said stop means is in said blocking position, said finger being operable to hold said barrel out of contact with said breech block.

4. A powder actuated tool comprising:

(a) a housing including a pistol grip and a cradle portion;

(b) a breech block mounted in said housing for reciprocal movement between a cocked position and an uncocked position;

(c) a firing pin mounted in said breech block for reciprocal movement between a cocked position and a fired position;

(d) a trigger mounted adjacent to said pistol grip and manually operable to release said firing pin from said cocked position to fire the tool;

(e) a barrel mounted on said cradle for reciprocal movement between a breech open position and a breech closed position, and said barrel being movable through a cocking stroke and against said breech block to move said breech block from said uncocked position to said cocked position;

(f) a slot in said housing on the side thereof opposite said pistol grip, said slot opening through said housing; and (g) stop means mounted in said slot and movable therein between a blocking position wherein said stop means contacts a breechward surface of said barrel to prevent said barrel from moving through said cocking stroke, and a clear position offset from said barrel to allow said barrel to move through said cocking stroke, and said stop means including a manual contact portion projecting beyond the exterior of said housing and spaced apart from said trigger sufficiently so as to require the operator to use one hand to operate the trigger and the other hand to move the stop means from said blocking position to said clear position to allow firing of the tool.

5. The tool of claim 4 further comprising spring means engaging said housing and said stop means to bias said stop means toward said blocking position.

6. The tool of claim 5 further comprising a transverse pin mounted in said slot, said stop means being pivotable on said pin between said blocking and clear positions, and wherein said spring means is sandwiched between said manual contact portion of said stop means and said housing.

7. The tool of claim 6 wherein said stop means includes a finger which projects into said housing when said stop means is in said blocking position to hold said barrel spaced muzzleward from said breech block.

8. The tool of claim 7 further comprising a nose portion on said stop means adjacent to said finger, which nose portion engages said housing to limit the extent of penetration of said stop means into said housing.

* * * * *